US007131405B2

(12) United States Patent
Lawes

(10) Patent No.: US 7,131,405 B2
(45) Date of Patent: Nov. 7, 2006

(54) ROTATING CYLINDER VALVE ENGINE

(75) Inventor: Keith Trevor Lawes, Poole Dorset (GB)

(73) Assignee: RCV Engines Limited (GB)

( * ) Notice: Subject to any disclaimer, the term of this patent is extended or adjusted under 35 U.S.C. 154(b) by 0 days.

(21) Appl. No.: 10/398,039

(22) PCT Filed: Sep. 26, 2001

(86) PCT No.: PCT/GB01/04304

§ 371 (c)(1),
(2), (4) Date: Aug. 12, 2003

(87) PCT Pub. No.: WO02/27165

PCT Pub. Date: Apr. 4, 2002

(65) Prior Publication Data

US 2004/0020450 A1 Feb. 5, 2004

(30) Foreign Application Priority Data

Sep. 27, 2000 (GB) ..... 0023595.2

(51) Int. Cl.
*F02B 75/20* (2006.01)

(52) U.S. Cl. ..... 123/59.3; 123/43 R; 123/192.2

(58) Field of Classification Search ..... 123/59.3, 123/80 C, 65 VA, 312, 48 R, 78 A, 78 C, 123/48 C, 43 R, 313, 314, 192.2
See application file for complete search history.

(56) References Cited

U.S. PATENT DOCUMENTS

| | | | | |
|---|---|---|---|---|
| 1,855,929 | A * | 4/1932 | Sperry | 123/80 C |
| 5,191,863 | A * | 3/1993 | Hagiwara | 123/59.3 |
| 6,289,872 | B1 * | 9/2001 | Dardalis | 123/314 |

FOREIGN PATENT DOCUMENTS

| | | |
|---|---|---|
| EP | 0 016 381 A | 10/1980 |
| EP | 0 464 201 A | 1/1992 |
| FR | 663 166 A | 8/1929 |
| GB | 2 129 488 A | 5/1984 |
| WO | WO 98 03781 A | 1/1998 |

* cited by examiner

*Primary Examiner*—Henry C. Yuen
*Assistant Examiner*—Hyder Ali
(74) *Attorney, Agent, or Firm*—Christensen O'Connor Johnson Kindness PLLC

(57) ABSTRACT

A rotating cylinder valve engine provides variable compression to the engine by axially moving the rotatable cylinder towards or away from the piston. The volumetric center of the combustion chamber is offset from the central axis of the piston. The engine cylinder is also ported to optimize performance.

14 Claims, 5 Drawing Sheets

ROTATING CYLINDER VALVE ENGINE

CROSS-REFERENCE TO RELATED APPLICATION

This application is a national stage application of prior International Application No. PCT/GB01/04304, filed Sep. 26, 2001, which claims the benefit of United Kingdom application No. 0023595.2, filed Sep. 27, 2000, which are incorporated herein by reference.

The present invention relates to all engine comprising a rotating cylinder wall and a reciprocating piston.

For known engines which comprise a rotating cylinder wall and a reciprocating piston the linear motion of the reciprocating piston is converted into the rotation of the cylinder wall. The rotation of the wall is utilised for the opening and closing of the inlet and outlet ports of the engine. An example of a rotating cylinder valve engine is described in specification of PCT patent application no. PCT/GB97/01934 in the name of RCV Engines Limited. The specification describes a rotating cylinder engine for a model aircraft. However, the skilled person in the art will realise that the engine described in this document may be adapted for many different applications.

According to a first aspect of the present invention there is provided a rotating cylinder valve engine comprising a piston disposed within a rotatable cylinder, and a combustion chamber defined by the piston and the cylinder, characterised in that the rotatable cylinder comprises a tubular mid-section formed with a closed end and an open end, the rotating cylinder valve engine comprising means to axially move the cylinder relative to the piston to alter the compression ratio of the engine.

The means to axially move the cylinder preferably comprises spring means disposed externally of the cylinder and adjacent the closed end of the rotatable cylinder.

Preferably in use the spring means provides a self regulating compression adjustment.

Alternatively, the means to axially move the cylinder comprises an actuator disposed externally of the cylinder and adjacent the closed end of the rotatable cylinder.

The rotating cylinder valve engine preferably further comprises rotatable cylinder damper means, the arrangement being such that in use the damper means restricts the axial oscillation of the rotatable cylinder.

The damper means preferably comprises a hydraulic damping system.

One of the primary determinants of the efficiency of a rotating cylinder valve engine is the compression ratio. In general the higher the compression ratio the quicker the flame front advances through the charge, the more efficient the combustion reaction, and the more mechanically efficient the engine becomes. However, if the compression ratio is raised too far peak cylinder pressures become very high causing mechanical stress and rough running. High cylinder pressures may also cause the charge to explode rather than burn, this being referred to as detonation or knock. The compression ratio on fixed compression engines is thus set at the maximum value that can be accommodated without mechanical damage or detonation occurring at full throttle.

The first aspect of the present invention provides variable compression to the rotating cylinder valve (RCV) engine and helps to increase part throttle fuel efficiency by maintaining the effective compression ratio at its optimum level throughout the entire throttle range. This is done by axially moving the RCV rotatable cylinder towards or away from the piston.

Variable compression may be accomplished on the RCV engine design because the rotatable cylinder is a simple closed end structure that can be moved without affecting the rest of the components of the engine. On a conventional engine the complex inter-related construction of the cylinder block, cylinder head and valve mechanism makes variable compression very hard to achieve.

According to a second aspect of the present invention there is provided a rotating cylinder valve engine comprising a piston disposed within a rotatable cylinder and a combustion chamber defined by the piston and the cylinder the arrangement being such that the volumetric centre of the combustion chamber is offset from the central axis of the piston.

The cylinder comprises a gas access port and the volumetric centre of the combustion chamber is preferably offset towards the gas access port.

The offset combustion chamber is preferably partly defined by a curved surface formed in the closed end of the cylinder.

The maximum length parallel to the central axis of the piston of the combustion chamber is preferably adjacent the gas access port.

The curved surface formed in the closed end of the cylinder preferably extends from the gas access port in a direction towards the piston.

There may be a second curved surface formed in the inner surface of the closed end of the cylinder, the second curved surface extending from the edge of the inner surface in a direction towards the other curved surface.

The radius of curvature of the second curved surface is preferably generally greater than the radius of curvature of the other curved surface.

The second aspect of the present invention has the aim of moving the bulk of the cylinder charge of fuel gases nearer to the cylinder port and thus nearer to the ignition point. This reduces flame front propagation delay and also reduces the volume of trapped static gas pockets that could cause detonation.

According to a third aspect of the present invention there is provided a rotating cylinder valve engine comprising a piston disposed within a rotatable cylinder formed with a gas access port the arrangement being such that the longitudinal horizontal central axis of the inlet port that extends through the wall of the cylinder does not intersect the longitudinal vertical central axis of the cylinder.

The rotating cylinder engine preferably comprises a combustion chamber defined by the piston and the cylinder the arrangement being such that the volumetric centre of the combustion chamber is offset from the central axis of the piston as specified by the second aspect of the present invention.

The third aspect of the present invention produces a circular motion of the inlet fuel gas charge, known as swirl. The third aspect combined with the offset combustion chamber, according to the second aspect of the present invention, moves the edge of the swirl towards the ignition point, which improves the ignition process. This is for two main reasons. Firstly the swirl tends to centrifuge the heavier suspended fuel droplets towards the outside of the swirl. This means that the ignition source, which is on the edge of the cylinder, is in the richest part of the charge and is thus is more likely to achieve satisfactory ignition. Secondly the movement of the charge past the ignition point will tend upon ignition to produce a flame trailing out from the ignition point in the direction of movement of the swirl. This increases the speed of propagation of the flame front and makes it more likely that the flame front will spread through the entire charge avoiding partial combustion or misfire.

According to a fourth aspect of the present invention there is provided a rotating cylinder valve engine comprising a piston disposed within a rotatable cylinder formed with a gas access port, the arrangement being such that when the piston is at the top dead-centre of the stroke the base portion of the piston is adjacent the lowermost edge of the access port.

The fourth aspect of the present invention enables the inlet port and exhaust port to be made as large as possible, this improves the breathing of the engine and thus its maximum power output. The width of the cylinder port (i.e. dimension around the circumference) is limited by the outer diameter of the cylinder and the timing of the engine, thus the only way to increase the port area is to increase its height (i.e. dimension parallel to the piston stroke). To avoid affecting the combustion chamber shape the port is made larger by moving the bottom edge of the cylinder port downwards. The farthest the port can be extended in this direction is the position of the top edge of the top piston ring at top dead-centre (TDC), moving it any further would produce a leak path past the top ring. With this configuration of port the piston crown will overlap the cylinder port at TDC. To maximise the cylinder port area it would be possible to move the piston ring further down the piston than is conventional.

For maximum breathing it would be possible to have the piston ring around the bottom edge of the piston. With this radical configuration the main combustion chamber would be to the side of the piston and formed by the edges of the cylinder port itself.

The fourth aspect of the present invention helps to improve the breathing of the engine and thus the potential maximum power.

According to a fifth aspect of the present invention there is provided a rotating cylinder valve engine comprising a piston disposed within a rotatable cylinder and a cylinder jacket surrounding the rotatable cylinder, the cylinder jacket and rotatable cylinder being formed with gas fluid access ports extending there through and the cylinder jacket comprising sealing means.

Preferably the sealing means comprises an annular sealing element held within an annular groove formed in the radially innermost surface of the cylinder jacket, the arrangement being such that in use the radially innermost surface of the annular sealing element forms a tight seal with the radially outermost surface of the rotatable cylinder.

In an embodiment the annular sealing element is held within an annular groove formed in the radially innermost surface of an annular timing ring disposed within the engine, the arrangement being such that in use the radially innermost surface of the annular sealing element forms a tight seal with the radially outermost surface of the rotatable cylinder.

There is preferably a high degree of dimensional tolerance between the sealing element and the radially outermost surface of the rotatable cylinder that provides the tight seal formed there between.

The sealing means may also be provided by a high degree of dimensional tolerance between the radially outermost surface of the rotatable cylinder and the radially innermost surface of the cylinder jacket.

Preferably the sealing element is disposed axially below the gas access port of the rotatable cylinder.

The sealing means preferably comprises a second annular sealing element held within an annular groove formed in the radially innermost surface of the cylinder jacket, the second sealing element being disposed axially above the gas access port of the rotatable cylinder.

Alternatively, the seal means comprises a second annular sealing element held within an annular groove formed in the radially outermost surface of the rotatable cylinder, the arrangement being such that in use the radially outermost surface of second sealing element forms a tight seal with the radially innermost surface of the cylinder jacket.

The wall thickness of the rotatable cylinder may be reduced due to the use of the sealing element held within a groove in the cylinder jacket. If a conventional external sealing ring was used that is set into the rotatable cylinder then this would require the wall thickness of the rotatable cylinder to be increased to hold the sealing ring. This would increase the average distance between the ignition point and the mixture in the combustion chamber, and would move the ignition point further away from the edge of any swirl in the chamber. It would also make the cylinder heavier.

The skilled person in the art will appreciate that this limitation does not necessarily apply to the top sealing ring as there is no limit to the wall thickness of the rotating cylinder above the cylinder port, hence a more conventional external sealing ring could be used for the top seal if required.

According to a sixth aspect of the present invention there is provided a rotating cylinder valve engine comprising a piston disposed within a rotatable cylinder and a cylinder jacket surrounding the rotatable cylinder, the cylinder jacket and rotatable cylinder being formed with gas fluid access ports extending there through and the rotating cylinder being provided with friction reducing and cooling means.

Preferably, the friction reducing and cooling means is an oil pump whereby in use oil is forced over the rotating cylinder.

Alternatively, the friction reducing and cooling means is achieved by the interaction of a close fitting cylinder jacket around the rotating cylinder the arrangement being such that in use the oil is forced between the respective adjacent surfaces of the cylinder jacket and the rotating cylinder.

Preferably, the oil pump is disposed at one end of the rotatable cylinder.

An advantage provided by the sixth aspect of the present invention is that the outer surface of the rotating cylinder is directly cooled. In one embodiment the cylinder jacket forces the oil over the whole surface of the rotating cylinder. This is a far more practical method than a water cooling system which would require rotating seals around the cylinder. These would be prone to seepage causing problems with water contamination of the lubricant.

According to a seventh aspect of the present invention there is provided a rotating cylinder valve engine comprising a piston disposed within a rotatable cylinder, a crankshaft assembly comprising a crankshaft and a gear and a balancing assembly comprising a balancing element and a gear, the balancing assembly being disposed on the opposite side of the engine to the crankshaft whereby, in use, the balancing element provides a balancing function to the engine, at the open end of the rotatable cylinder there being formed a bevel gear that engages the gear of the crankshaft assembly and the gear of the balancing assembly.

Preferably, the balancing element is a substantially L-shaped shaft the arrangement being such that in use the shaft rotates in a direction that is opposite to the direction of the crankshaft.

According to an eighth aspect of the present invention there is provided a rotating cylinder valve engine comprising a piston disposed within a rotatable cylinder one end of which being formed with a bevel gearing that engages a drive gear, and a crankshaft assembly comprising a crankshaft rotatable about a first axis and being supported in a tubular sleeve having a central axis offset from the first axis, the arrangement being such that in use the clearance between the bevel gearing and the drive gear is adjustable by rotating the tubular support sleeve about the central axis of the tubular support sleeve.

The eighth aspect of the present invention provides gear clearance adjustment means that does not necessarily require shims, machining or disassembly.

According to an ninth aspect of the present invention there is provided a method for starting a rotating cylinder valve engine comprising a piston disposed within a rotatable cylinder formed with a bevel gearing at one end of the cylinder that engages a drive gear, a crankshaft assembly and a starting mechanism, the method comprising applying the starting mechanism to the rotatable cylinder.

The ninth aspect of the present invention is mainly of advantage to rotating cylinder valve engines that comprise a propeller where the method enables the operator to stay behind the propeller during the starting procedure. Starting the engine from behind propeller is safer and more convenient as the user does not have to work around the propeller as when starting from in front of the engine in the conventional manner. For an engine without a propeller the method may offer some advantages in terms of mechanical packaging and gearing.

There are particular advantages to combining the features of the various aspects of the present invention and the invention may include any combination of the features or limitations referred to herein.

The present invention may be carried into practice in various ways and some embodiments will now be described, by way of example only, with reference to the accompanying drawings in which.

Figure 1:
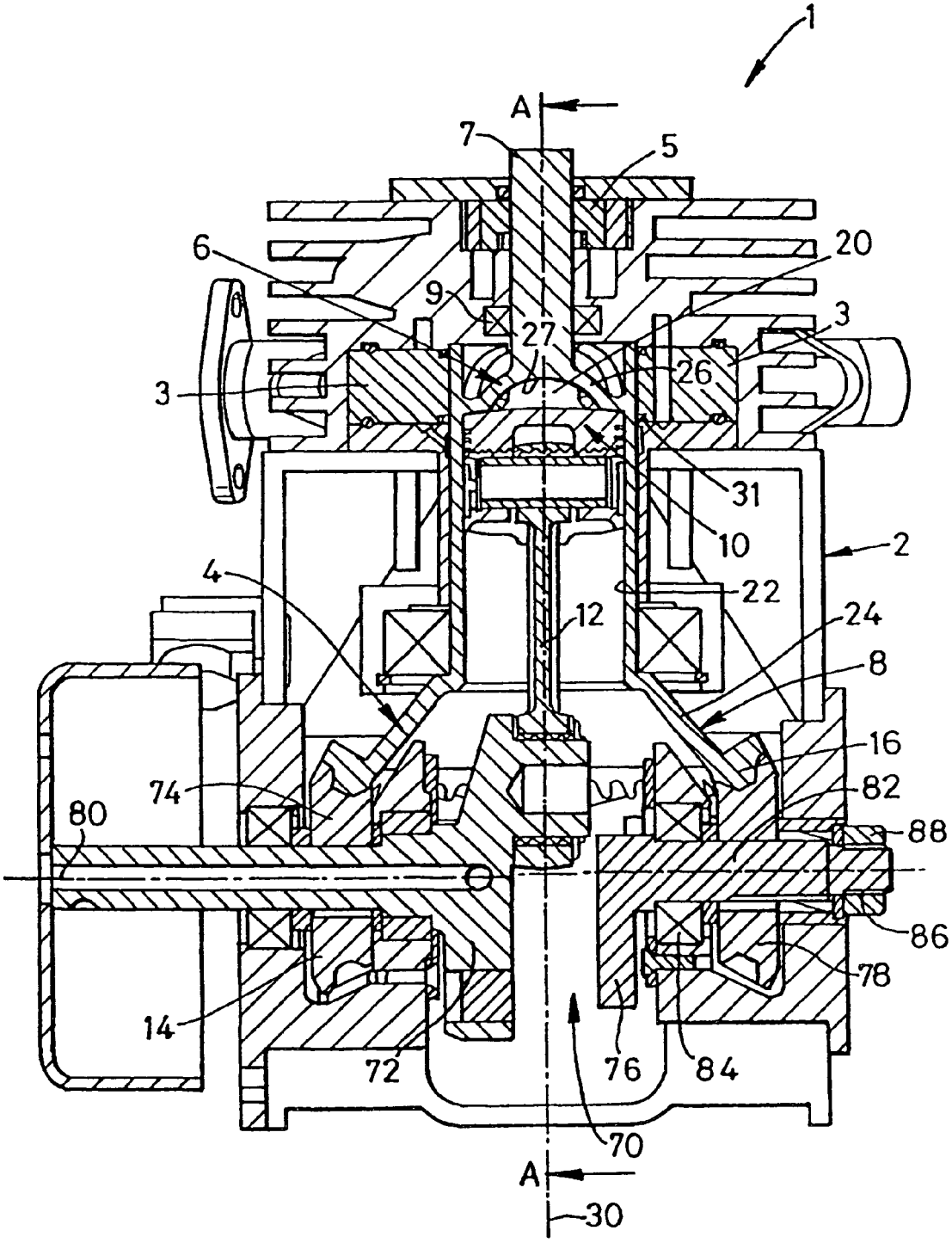
FIG. 1 is a side view of a cross section of a rotating cylinder valve engine.
Figure 2:
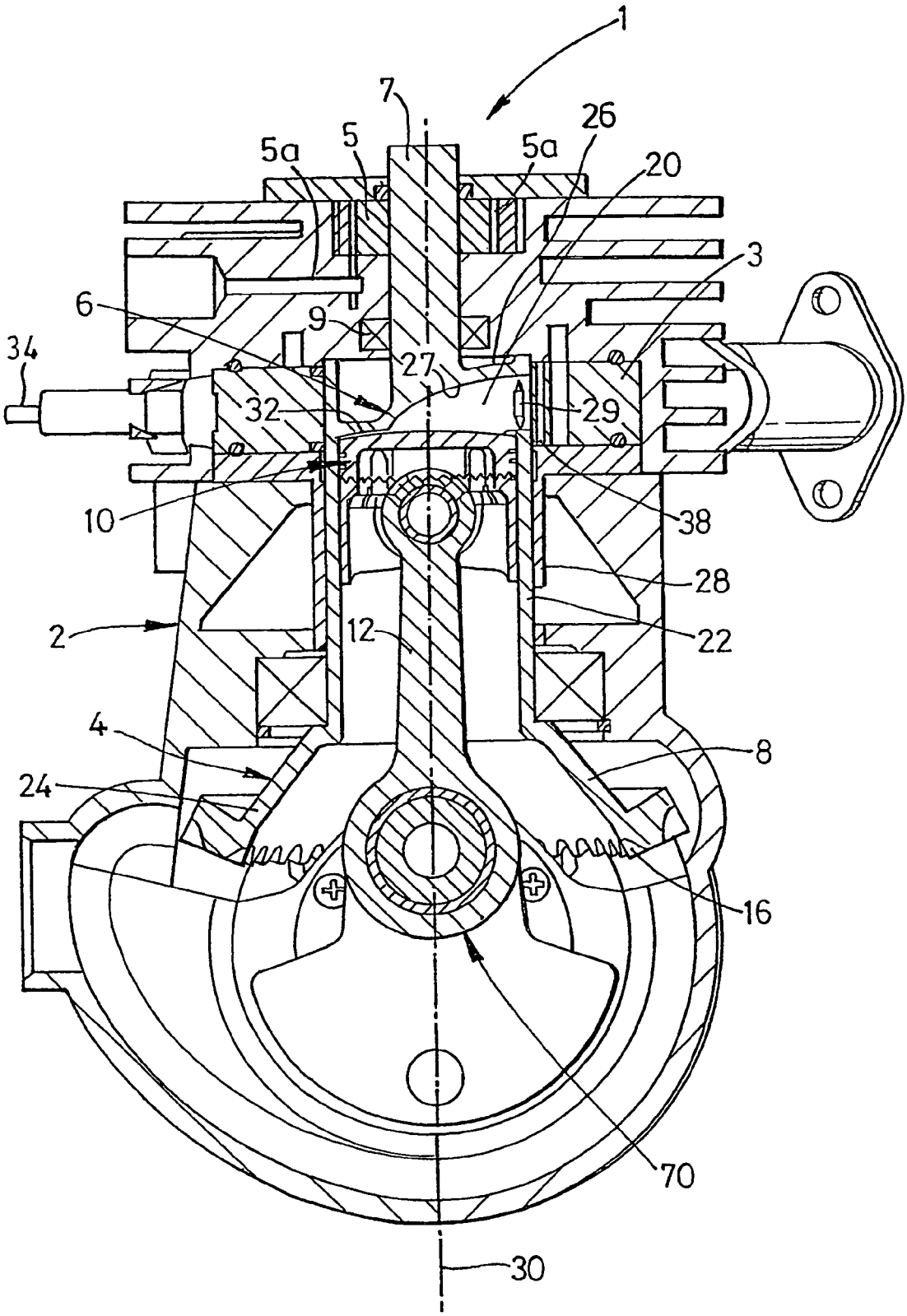
FIG. 2 is a side view through cross section AA of the engine shown in FIG. 1.
Figure 4A:
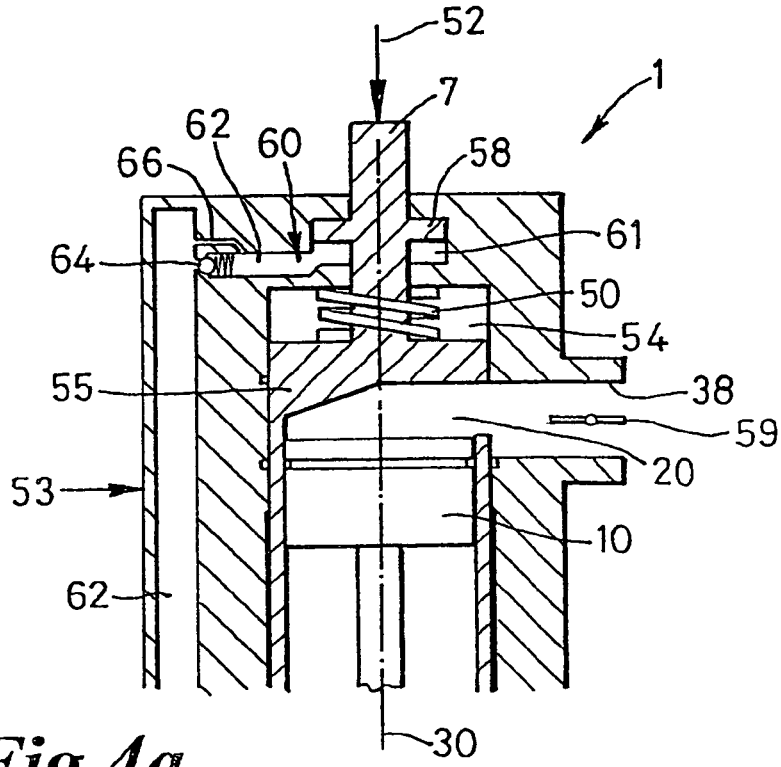
Figure 4B:
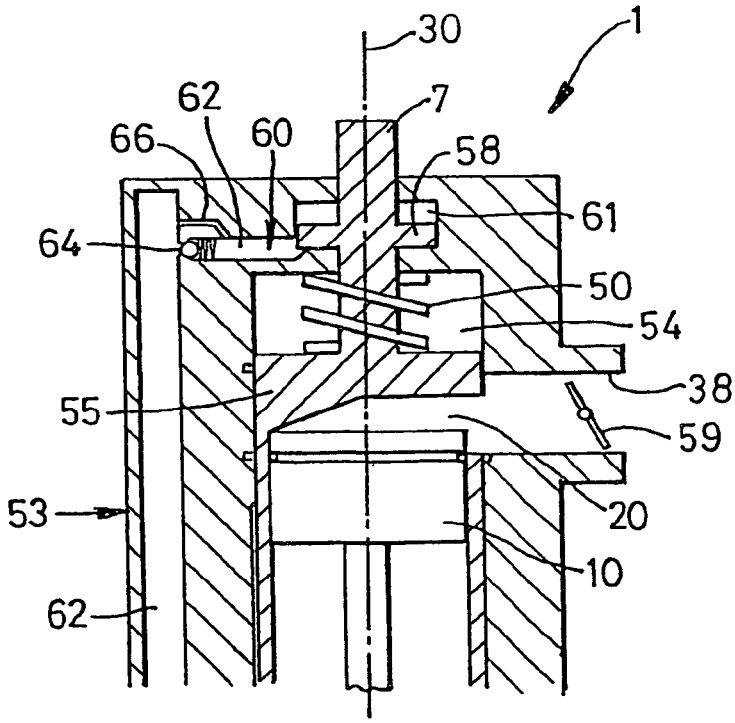
Figure 5A:
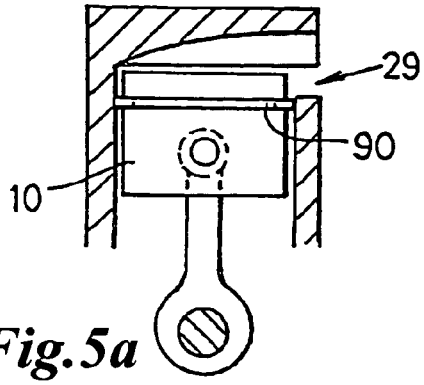
Fig.5a PRIOR ART
Figure 5B:
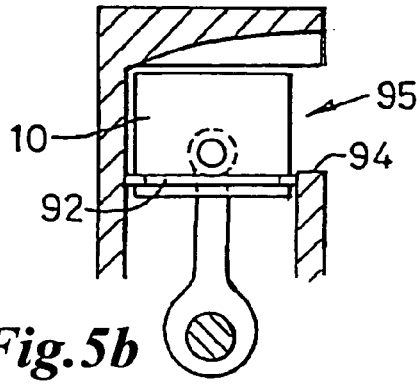
Figure 6:
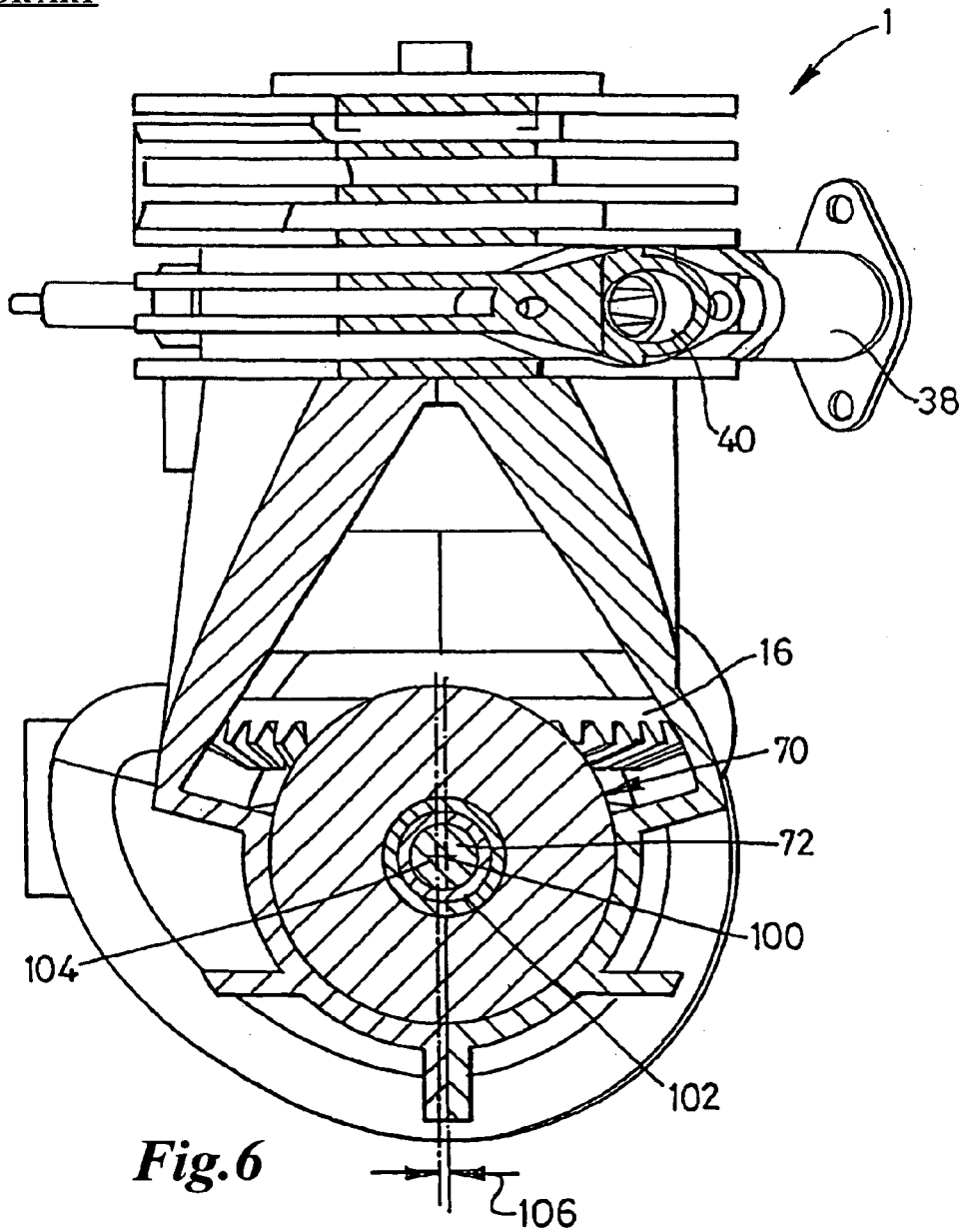

FIG. 4*a* is a cross section view of a schematic of a portion of a rotating cylinder valve engine comprising a self-regulating spring operative to axially move a cylinder relative to a piston and shows the engine in a full throttle configuration;

FIG. 4*b* is a cross section view of the engine shown in FIG. 4*a* and shows the engine in a part throttle configuration;

FIG. 5*a* is a side view sketch of a cross section of a piston and a rotatable cylinder arrangement of a rotating cylinder valve engine comprising sealing means located at the upper end of the piston;

FIG. 5*b* is a side view sketch of a cross section of a piston and a rotatable cylinder arrangement of a rotating cylinder valve engine comprising sealing means located at the lower end of the piston to that shown in FIG. 5*a*; and FIG. 6 is a side view of a partial cross section of the rotating cylinder valve engine shown in FIGS. 1 and 2.

The main principles of the operation of a rotating cylinder valve engine is substantially described in the specification of the international patent application no PCT/GB97/01934 in the name of RCV Engines Limited. The specification of this application describes a rotating cylinder valve engine used for a model aircraft. The rotating cylinder and engine housing cooperate to provide a fuel inlet valve and an exhaust outlet valve. The rotating cylinder also provides the power output of the engine to the propeller. The skilled person in the art will appreciate that the power output means may be provided by the crankshaft assembly instead of, or as well as, the rotating cylinder.

The various aspects of the present invention relate to improvements to the basic rotating cylinder valve engine design.

Figure 3:
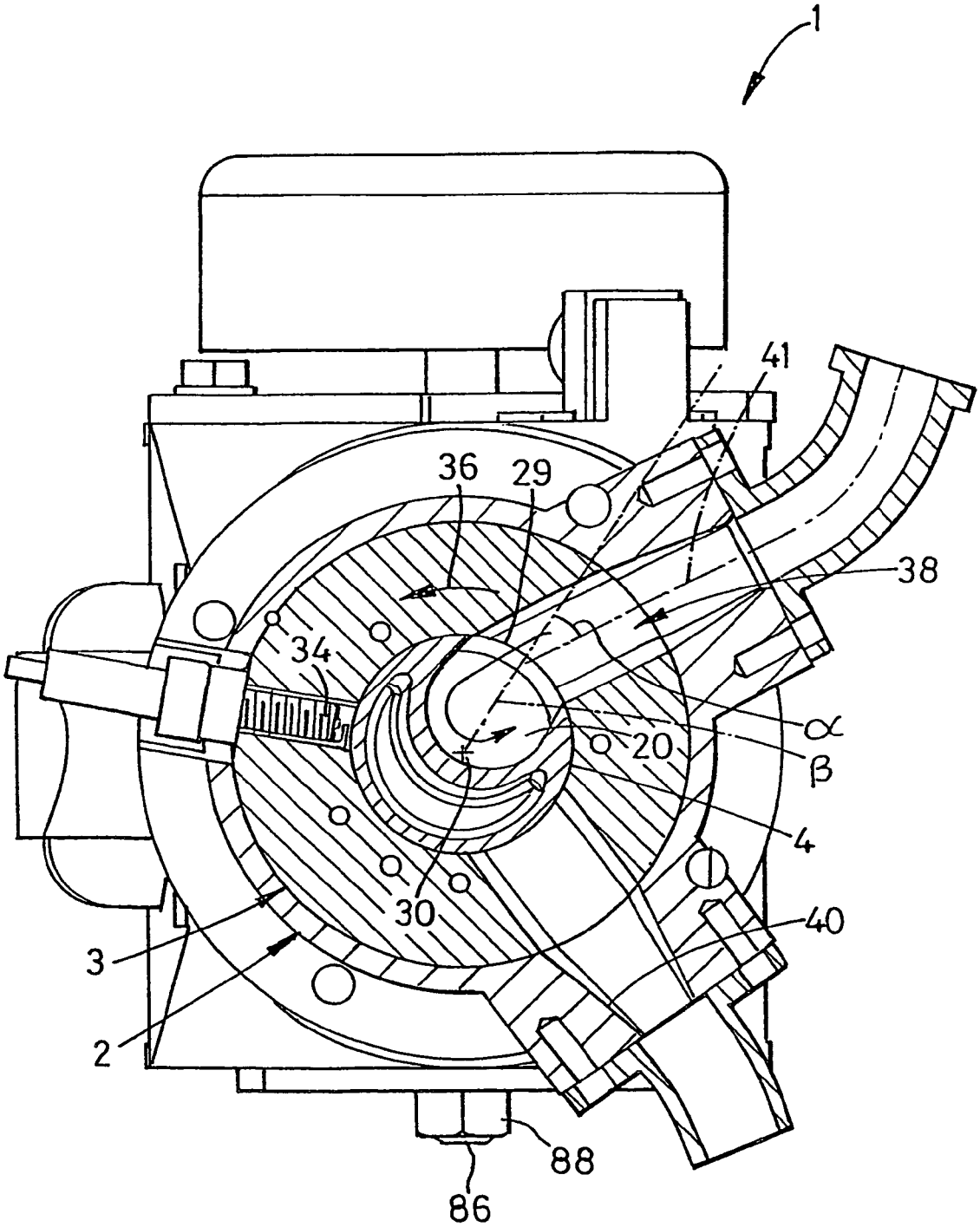
FIG. 3 is a plan view of a cross section of an upper portion of the rotating cylinder valve engine shown in FIGS. 1 and 2.

With reference to the FIGS. 1, 2 and 3, a rotating cylinder valve engine 1 comprises an engine housing 2 that contains an annular timing ring 3, a rotatable cylinder 4 formed with a closed end 6 and an open end 8; and a piston 10 disposed within the cylinder 4. The cylinder 4 is mechanically driven by the piston 10 via transmission assembly that comprises a con rod 12 that drives a gear 14 that in turn engages a bevel gear 16 formed at the open end 8 of the cylinder 4. At the closed end 6 of the cylinder 4 there is an integral central rod 7 that extends axially away from the cylinder 4. There is an annular ball bearing 9 disposed at the one end of the rod 7.

Oil pump means is disposed on the rod 7 within the housing 2. The oil pump means comprises an annular ring 5 formed with a central circular hole and a network of oil channels 5*a*. In use oil is drawn through the network of channels 5*a* and into to the central hole by the rotational action of the rod 7. The oil then flows through channels in the annular timing ring 3 and is then forced between the cylindrical sleeve 28 and rotatable cylinder 4; this provides cooling means for both the annular timing ring 3 and the rotatable cylinder 4. Once the oil is in the crank case the oil provides lubrication for the other moveable components in the engine 1.

The rotating cylinder valve engine 1 also comprises a combustion chamber 20, according to the second aspect of the present invention, that is defined by a portion of the uppermost surface of the piston 10 and the radially inner surface of the cylinder 4. The cylinder 4 comprises a tubular mid-section 22 having a substantially circular horizontal cross section, a frusto-conical lower section 24 and an upper section 26 formed with a curved inner surface 27 that extends inwardly from an access port 29. The access port 29 extends through the wall of the cylinder 4 and provides an inlet for the fuel when indexed with a fuel port and an outlet for the exhaust when indexed with an exhaust port. The cylinder 4 is disposed within the annular timing ring 3 and a substantially cylindrical sleeve 28 that forms part of the engine housing 2. The annular timing ring 3 is formed with an inlet port 38. Disposed within the mating surface of the annular timing ring 3 is an annular seal 31 according to the fifth aspect of the present invention. The seal 31 is held within an annular groove formed in the radially innermost surface of the timing ring 3.

The volumetric centre of the combustion chamber 20 is offset from the central axis 30 of the cylinder 4. The bulk of the cylinder charge of fuel gases within the chamber 20 is nearer to the access port 29. Thus the fuel gas is nearer to the ignition point of the ignition source 34 (such as a glow plug or a spark plug) when the cylinder rotates in direction 36 to this location and indexes with the ignition source 34. This reduces flame front propagation delay on ignition and also reduces the volume of trapped static gas pockets that could cause detonation of the fuel.

For some engines the upper section 26 of the cylinder may also be formed with a second curved portion 32 that that forms a 'squish band'. The second curved portion 32 extends radially inward from the radially innermost surface of the mid-section 22 and meets the curved surface 27.

A well designed combustion chamber 20 will cause the compressed charge within it to burn in a controlled and efficient manner, with the combustion process taking the form of a flame front advancing rapidly through the charge. Poor combustion chamber design can cause one of two major problems. Firstly detonation or knock, where combustion occurs as a violent instantaneous explosion rather than a controlled bum. Secondly incomplete combustion, where the flame front extinguishes before all the fuel in the charge has been burnt.

Detonation occurs where the temperature and pressure in part or all of the charge rises to such a level that the charge spontaneously explodes. This causes a very rapid and destructive rise in cylinder pressure that can result in engine damage. Detonation will tend to occur as the compression ratio of the engine is increased. The better the combustion chamber design the higher the compression ratio that can be used before detonation occurs. The overall shape of the combustion chamber 20 and the presence of hot spots are the most crucial factors in this aspect of combustion chamber design.

Incomplete combustion, or misfire, occurs where the flame front is extinguished before it has progressed throughout the entire mixture. This will tend to occur as the mixture deviates from stoichiometric, in particular as it becomes leaner. The better the combustion chamber design the leaner the mixture that can be used before incomplete combustion, or misfire, starts to occur. The position of the ignition source and the movement of the charge gas are the most crucial factors in this aspect of combustion chamber performance.

With particular reference to FIG. 3, the engine housing 2 is formed with a fuel inlet port 38, according to the third aspect of the present invention, that extends through the wall of the housing 2 and an exhaust port 40. The longitudinal central axis 41 of the inlet port 38 does not intersect the longitudinal central axis 30 of the cylinder 4. The longitudinal central axis 41 of the inlet port 38 is at an obtuse angle '$\alpha$' from the radii '$\beta$' extending from the axis 30. Due to this angle '$\alpha$' the inlet port produces a circular motion of the inlet fuel known as swirl.

The combustion chamber 20 should primarily be designed to run as high a compression ratio as possible and as lean a mixture as possible whilst avoiding both detonation and incomplete combustion. High compression and lean mixture will maximise both the power output and fuel efficiency of the design. To this end in general the main features required in a combustion chamber design are—

(i) Compact Shape

A compact combustion chamber shape reduces the tendency for detonation. The most undesirable feature in any combustion chamber is a significant volume of non-moving gas trapped in a pocket a considerable distance away from the ignition source. This trapped end gas will tend to cause detonation. This is because as the flame front advances from the ignition point towards the pocket of end gas the expanding burning gas acts as a piston on the trapped gas. This causes shock waves and a rapid rise in pressure within the end gas pocket, which will then tend to spontaneously detonate. This problem can most notably be seen on traditional side valve engine designs. The large pockets of trapped end gas over the valves means side valve engines can only be run at extremely low compression ratios before detonation occurs. They thus offer both low power output levels and poor fuel efficiency.

A second advantage of a compact combustion chamber shape is that the internal surface area is minimised. This improves the thermodynamic efficiency of the chamber. A combustion chamber with a large internal surface area will loose more heat energy through conduction. This will reduce the temperature and pressure of the burning charge, and thus reduce the mechanical force and power available.

(ii) Smooth Internal Shape.

The internal shape of the combustion chamber should be as smooth as possible. This is because sharp edges tend to form hot spots which can cause pre-ignition which will in turn lead to detonation. If a hot spot occurs the mixture will tend to ignite at this point, often at a very advanced crank angle. The flame front from the hot spot will then advance towards the flame front from the actual ignition source. This will tend to cause detonation in the gas trapped between the two flame fronts. Ideally to avoid hot spots the radii of all surfaces within the chamber should be greater than 3 mm.

(iii) Swirl

Swirl consists of the inlet charge spinning in an ordered manner around the inside of the combustion chamber. In combination with a correctly positioned ignition point swirl reduces any tendency for incomplete combustion. Swirl is induced in the charge by angling the entrance of the inlet manifold into the combustion chamber so that the inlet charge is forced into a circular path by the cylinder wall. Swirl is defined as the circular movement of gas around the circumference of the cylinder. If circular flow is set up around an axis at 90 degrees to the cylinder axis this is known as tumble. Tumble can produce the same improvements as swirl but may not be as suitable for the RCV design due to the ignition position and general shape of the combustion chamber.

(iv) Ignition Source Position

In any combustion chamber with a swirling inlet charge the ignition source should be towards the edge of the chamber. This is to ensure the ignition source is within the most rapidly moving part of the swirling charge. When ignition occurs a flame will trail away from the spark or glow plug. This improves flame front propagation and reduces the chances of incomplete combustion.

A second benefit is that the spinning charge will tend to centrifuge the heavier fuel droplets towards the outside of the charge, causing the mixture at the edges of the swirl to be richer. The richer part of this "stratified charge" will be set alight by the ignition source, the flame front will propagate reliably through this outer richer section, and will then be so well established that it will propagate through the remaining less rich section of the charge. This enables the engine to be run with a leaner mixture.

In summary the combustion chamber/port design has to be compact with no sharp edges, have a mechanism to induce swirl, have an ignition point as close as possible to the edge of the swirling charge. The initial design for the combustion chamber is a form of "squish" design where the combustion chamber is a considerably smaller diameter than the main cylinder bore, with the piston coming right up to the underside of to the squish area to ensure all the mixture is forced up into the combustion chamber itself. This provides a compact shape with no significant trapped end gas volumes and is similar in aspect ratio to many conventional poppet valve designs.

The inlet port 38 is angled to cause the mixture to swirl around the combustion chamber 20. The combustion chamber 20 is offset within the rotating cylinder to make the cylinder port itself as short as possible. This ensures that the ignition source is as close possible to the outer edge of this swirl. The offset combustion chamber design affects the seal design for the rotary valve.

It would be more conventional to use external sealing rings set into the outside of the rotating cylinder. However because of the offset combustion chamber there is not enough material available on the rotary cylinder in the area below the cylinder port to accept conventional external sealing rings, hence internal sealing rings are used set into the inner surface of the rotary valve.

With reference to FIGS. 4*a* and 4*b*, an embodiment of the rotating cylinder valve engine 1 according to the first aspect of the present invention comprises spring means 50 for axially moving the cylinder 55 relative to the piston 10 in order to alter the compression ratio of the engine. The spring means 50 provides an axial force to the cylinder in the direction 52 towards the piston 10. The spring means 50 is disposed within a cylindrical chamber 54 defined by an end of the tubular section formed in the engine housing 53 and the end portion of the cylinder 55. The spring means 50 winds around the rod 7 that extends axially from the cylinder 55.

The rotating cylinder 55 is arranged so that it can be moved towards and away from the piston 10 to vary the compression ratio of the engine 10. The rotating cylinder 55 can either be moved by an external actuator (not shown), or is mounted on a spring means 50 to provide a self-regulating action.

On a crank driven RCV engine in order to enable the cylinder 55 to move relative to the piston 10 without disturbing the gear mesh, the cylinder 55 is mounted on splines within the cylinder bevel gear 16. The cylinder 55 can then move axially up and down whilst the bevel gear 16 stays in its correct mesh position.

The engine 1 shown in FIGS. 4*a*, 4*b* comprises self regulating spring means 50. The engine 1 is shown in its part throttle configuration in FIG. 4*b*. The rotating cylinder 55 has been moved by the spring means 50 closer to the piston 10 to minimise the volume of the combustion chamber 20. This increases the effective compression ratio and part throttle operating efficiency of the engine 1.

The compression control mechanism of the engine 1 comprises strong spring means 50 together with an end stop and damping mechanism 60. The spring means 50 forces the cylinder 55 half down towards the highest compression position of the cylinder 55 i.e. towards the piston 10. The compression force of the spring means 50 is set to maintain the correct desired maximum cylinder pressure in a similar manner to a spring controlled pressure regulator, i.e. the spring compression force would equal the bore area x the desired cylinder pressure. At start up the cylinder 55 would be resting on its end stop in its high compression position i.e. as near as possible to the piston 10. As the piston 10 approaches top dead centre (TDC) the cylinder pressure starts to rise above the desired maximum. The spring means 50 then allows the cylinder 55 to move away from its end stop and the piston 10, maintaining an approximately constant cylinder pressure. The more open the throttle 59 the further the cylinder 55 will move away from the piston 10 to maintain the correct cylinder pressure.

The damping mechanism 60 comprises a disc-shaped piston 58 that is formed on a portion of the rod 7. In use the piston 58 reciprocates within a cylindrical chamber 61 formed in the engine housing 53.

In its simplest form without any damping the cylinder 55 will move in conjunction with the piston 10 over the top of its stroke. The cylinder 55 will only move over a short distance and will move comparatively slowly, but this may prove to be undesirable.

To avoid this oscillation the damping mechanism 60 can be employed. The mechanism 60 includes a damping oil channel 62 that extends from the chamber 61 formed in the engine housing 53 and a non-return valve 64 contained within the channel 62. The non-return valve 64 allows oil to flow freely from the channel 62 into the chamber 61 when the cylinder is moving away from the piston, but closes when the cylinder moves back towards the piston. A much more restrictive leak path 66 then allows the cylinder to move slowly back towards its part throttle i.e. higher compression setting. This means that when applying full throttle to the engine 1 the cylinder 55 will instantly move away from the piston 10 towards its full throttle setting, drawing oil through the non-return valve 64, but at part throttle the cylinder 55 will only gradually settle back to its closer part throttle setting, forcing oil through the restrictive leak path 66 as it does so.

An actuator-controlled version of the engine 1 could use any conventional actuator method for moving the cylinder 55 relative to the piston 10 e.g. stepper motor and lead screw, hydraulic actuator and cam etc.

One of the primary determinants of the efficiency of an engine is compression ratio. In general the higher the compression ratio the quicker the flame front advances through the charge, the more efficient the combustion reaction, and the more mechanically efficient the engine becomes. However if the compression ratio is raised too far peak cylinder pressures become very high causing mechanical stress and rough running. High cylinder pressures may also cause the charge to explode rather than burn, this being referred to as detonation or knock. The compression ratio on fixed compression engines is thus set at the maximum value that can be accommodated without mechanical damage or detonation occurring at full throttle.

When running at part throttle the initial pressure of the inlet charge drawn into the cylinder is considerably less than 1.0 bar, typically being between 0.3 and 0.6 bar. Peak cylinder pressures are correspondingly reduced, and the effective compression ratio is well below its optimum value. Thus at part throttle the engine is running at considerably reduced efficiency.

The variable compression RCV engine increases part throttle fuel efficiency by maintaining the effective compression ratio at its optimum level throughout the entire throttle range. This is done by moving the RCV cylinder towards or away from the piston as described above. It is estimated that improvements in part throttle fuel consumption of between 10% and 30% could be obtained by this method. In many applications engines spend most of their running time at part throttle hence this could have a very significant effect on overall fuel efficiency.

Variable compression is comparatively straightforward to accomplish on the RCV design because the cylinder is a simple closed end structure which can be moved without affecting the rest of the engines components. On a conventional engine the complex inter-related construction of the cylinder block, cylinder head and valve mechanism makes variable compression very hard to achieve.

With reference to FIG. 1, the engine 1 comprises a crankshaft assembly 70 comprising a crankshaft 72, a first drive gear 74, an L-shaped balancing shaft 76 and a second drive gear 78 according to the eighth aspect of the present invention. The balancing shaft 76 is driven by the bevel gear 16 via the second drive gear 78. The balancing shaft 76 and second drive gear 78 are disposed on the opposite side of the bevel gear 16 to the crankshaft 72. In use the crankshaft 72, the first drive gear 74, the L-shaped balancing shaft 76 and the second drive gear 78 rotate about the common horizontal axis 80. The balancing shaft 76 will rotate in an opposite direction about axis 80 to the crankshaft 72.

A portion 82 of L-shaped balancing shaft 76 that extends along the horizontal axis 80 is supported by an annular bearing 84. Disposed along the portion 82 is the second drive gear 78. The distal end of the portion 82 there is formed a threaded portion 86 upon which is screwed a holding nut 88.

With reference to FIG. 5*a* there is shown a sketch of a cross section of a piston and a rotatable cylinder arrangement. This arrangement illustrates a conventional rotating cylinder valve engine comprising a piston ring 90 located at upper end of the piston 10. FIG. 5*b* there is shown a sketch of a of a piston and a rotatable cylinder arrangement illustrating a rotating cylinder valve engine comprising piston ring 92 located at lower end of the piston 10. FIG. 5*b* shows an embodiment according to the fourth aspect of the invention. When the piston 10 is at the top dead-centre the piston ring 92 is adjacent the lowermost edge 94 of the cylinder inlet port 95. The inlet port 95 has a larger vertical cross sectional area than that of the inlet port 29. By providing a larger cross sectional area this helps to improve the breathing of the engine and thus increases its maximum power output. The width of the cylinder port (i.e. dimension around the circumference) is limited by the outer diameter of the cylinder and the timing of the engine, thus the only way to increase the port area is to increase its height (i.e. dimension parallel to the piston stroke).

With reference to FIG. 6, there shown the rotating cylinder valve engine according to the ninth aspect of the present invention comprising a piston 10 disposed within a rotatable cylinder formed with a bevel gear 16 at one end of the cylinder. The bevel gear 16 engages a drive gear (not shown) and a crankshaft assembly 70 comprising a crankshaft 72 rotatable about a first axis 100 and being supported a tubular sleeve 102 having a central axis 104 offset from the first axis 100 by a distance 106. The arrangement is such that in use the clearance between the bevel gearing 16 and the drive gear is adjustable by rotating the tubular support sleeve 102 about the central axis 104. Typically, the distance, 106 would be about 1 mm.

What is claimed is:

1. A rotatable cylinder valve engine characterized in that the engine comprises a piston disposed within a rotatable cylinder, a crankshaft assembly comprising a crankshaft and a gear and a balancing assembly comprising a balancing element and a gear, the balancing assembly being disposed on the opposite side of the engine to the crankshaft whereby, in use, the balancing element provides a balancing function to the engine, at the open end of the rotatable cylinder there being formed a bevel gear that engages the gear of the crankshaft assembly and the gear of the balancing assembly.

2. A rotatable cylinder valve engine as claimed in claim 1, wherein the balancing element is a substantially L-shaped shaft, the arrangement being such that in use the shaft rotates in a direction that is opposite to the direction of the crankshaft.

3. A rotatable cylinder valve engine characterized in that the engine comprises a piston disposed within a rotatable cylinder one end of which being formed with a bevel gearing that engages a drive gear, and a crankshaft assembly comprising a crankshaft rotatable about a first axis and being supported in a tubular sleeve having a central axis offset from the first axis, the arrangement being such that in use the clearance between the bevel gearing and the drive gear is adjustable by rotating the tubular support sleeve about the central axis of the tubular support sleeve.

4. A rotatable cylinder valve engine wherein the engine comprising a piston disposed within a rotatable cylinder and a cylinder jacket surrounding the rotatable cylinder, the cylinder jacket and rotatable cylinder being formed with gas fluid access ports extending therethrough, and the rotating cylinder being provided with an oil pump forming friction reducing and cooling means, the pump, in use, forcing oil over the rotating cylinder.

5. A rotatable cylinder valve engine as claimed in claim 4, wherein the friction reducing and cooling means is achieved by the interaction of a close fitting cylinder jacket around the rotating cylinder whereby in use the oil is forced between the respective adjacent surfaces of the cylinder jacket and the rotating cylinder.

6. A rotatable cylinder valve engine as claimed in claim 4, wherein the oil pump is disposed at one end of the rotatable cylinder.

7. A rotatable cylinder valve engine comprising a piston disposed within a rotatable cylinder and defining therebetween a combustion chamber, wherein the rotatable cylinder comprises a tubular mid-section formed with a closed end and an open end, the rotatable cylinder valve engine further comprising a spring device disposed externally of the cylinder and adjacent the closed end of the rotatable cylinder for axially moving the cylinder relative to the piston to alter the compression ratio of the engine, wherein in use the spring device provides a self regulating compression adjustment.

8. A rotatable cylinder valve engine as claimed in claim 7, wherein the means to axially move the cylinder comprises an actuator disposed externally of the cylinder and adjacent the closed end of the rotatable cylinder.

9. A rotatable cylinder valve engine as claimed in claim 7, wherein the rotating cylinder valve engine comprises rotatable cylinder damper means, whereby in use the damper means restricts the axial oscillation of the rotatable cylinder.

10. A rotatable cylinder valve engine as claimed in claim 9, wherein the damper means comprises a hydraulic damping system.

11. A rotatable cylinder valve engine wherein the engine comprises a piston disposed within a rotatable cylinder formed with a gas access port, the arrangement being such that the longitudinal horizontal central axis of the inlet port that extends through the wall of the cylinder and does not intersect the longitudinal vertical central axis of the cylinder, and the volumetric center of the combustion chamber is offset from the central axis of the piston as specified by the second aspect of the present invention.

12. A rotatable cylinder valve engine wherein the engine comprises a piston disposed within a rotatable cylinder formed with a gas access port, the arrangement being such that when the piston is at the top dead-center of the stroke the base portion of the piston is adjacent the lowermost edge of the access port and a piston ring is disposed towards the bottom edge of the piston.

13. A rotatable cylinder valve engine comprising a piston disposed within a rotatable cylinder and a combustion chamber defined by the piston and the cylinder, wherein the arrangement of the rotatable cylinder and the combustion chamber is such that the volumetric center of the combustion chamber is offset from the central axis of the piston, wherein the offset combustion chamber is partly defined by a curved surface formed in the closed end of the cylinder, wherein the curved surface formed in the closed end of the cylinder extends from the gas access port in a direction towards the piston, and wherein a second curved surface is formed in the inner surface of the closed end of the cylinder, the second curved surface from the edge of the inner surface in a direction towards the other curved surface.

14. A rotatable cylinder valve engine as claimed in claim 13, wherein the radius of curvature of the second curved surface is generally greater than the radius of curvature of the other curved surface.

* * * * *